US009241522B2

(12) United States Patent
Branson

(10) Patent No.: US 9,241,522 B2
(45) Date of Patent: Jan. 26, 2016

(54) HEAD COVERING

(71) Applicant: Radians, Inc., Memphis, TN (US)

(72) Inventor: Daniel Paul Branson, Collierville, TN (US)

(73) Assignee: Radians, Inc., Memphis, TN (US)

( * ) Notice: Subject to any disclaimer, the term of this patent is extended or adjusted under 35 U.S.C. 154(b) by 0 days.

(21) Appl. No.: 14/183,641

(22) Filed: Feb. 19, 2014

(65) Prior Publication Data

US 2015/0230527 A1 Aug. 20, 2015

(51) Int. Cl.

| | |
|---|---|
| ***A41D 23/00*** | (2006.01) |
| ***A41D 27/28*** | (2006.01) |
| ***A41D 20/00*** | (2006.01) |

(52) U.S. Cl.

CPC ..... *A41D 20/005* (2013.01); *A41D 20/00* (2013.01); *A41D 23/00* (2013.01); *A41D 2023/002* (2013.01); *A41D 2023/004* (2013.01)

(58) Field of Classification Search

CPC ..... A41D 20/00; A41D 20/005; A41D 23/00; A41D 13/005; A41D 13/0056; A41D 13/11; A41D 13/1107; A41D 31/0016; A42C 5/02; A42C 5/04; Y10S 2/11; Y10S 2/918; A42B 1/008; A42B 1/22; A42B 1/045

See application file for complete search history.

(56) References Cited

U.S. PATENT DOCUMENTS

| | | | | | |
|---|---|---|---|---|---|
| 1,434,854 | A | * | 11/1922 | Stall | 2/171 |
| 1,689,539 | A | * | 10/1928 | Wagner | 2/171.2 |
| 1,907,709 | A | * | 5/1933 | Barrow | 2/171 |
| 1,922,944 | A | * | 8/1933 | Gobeille | 139/421 |
| 2,223,332 | A | * | 11/1940 | Sterne | 2/171 |
| 2,265,530 | A | * | 12/1941 | Kleinman | 2/181 |
| 2,783,474 | A | * | 3/1957 | Campagna et al. | 2/171 |
| 3,089,146 | A | * | 5/1963 | Sterne | 2/181 |
| 3,671,977 | A | * | 6/1972 | Degnon | 2/207 |
| 4,277,847 | A | * | 7/1981 | Florio | 2/12 |
| 4,391,073 | A | * | 7/1983 | Mollenkopf et al. | 52/241 |
| 4,449,977 | A | * | 5/1984 | Korpman | 604/366 |
| 4,502,156 | A | * | 3/1985 | Wishman | 2/181 |
| 4,521,922 | A | * | 6/1985 | Mitchell et al. | 2/171 |
| 4,675,915 | A | * | 6/1987 | Siciliano | 2/181 |
| 4,742,581 | A | * | 5/1988 | Rosenthal | 2/181 |
| 4,768,503 | A | * | 9/1988 | Highgate et al. | 602/52 |
| 4,776,042 | A | * | 10/1988 | Hanson et al. | 2/7 |
| 4,811,430 | A | * | 3/1989 | Janusz | 2/452 |
| 4,815,144 | A | * | 3/1989 | Martin | 2/7 |
| 4,856,116 | A | * | 8/1989 | Sullivan | 2/181 |
| 5,054,122 | A | * | 10/1991 | Sher | 2/7 |
| 5,146,630 | A | * | 9/1992 | Richard | 2/181 |
| D344,177 | S | * | 2/1994 | Mennie et al. | D2/610 |
| D351,052 | S | * | 10/1994 | Russell | D2/894 |
| 5,377,360 | A | * | 1/1995 | Fleitman | 2/181 |
| D374,333 | S | * | 10/1996 | Davis | D2/894 |
| 5,572,745 | A | * | 11/1996 | Mainus | 2/171.2 |
| D379,257 | S | * | 5/1997 | Leinoff | D2/894 |
| 5,640,721 | A | * | 6/1997 | Jackson | 2/171 |

(Continued)

*Primary Examiner* — Bobby Muromoto, Jr.
(74) *Attorney, Agent, or Firm* — Brinks Gilson & Lione

(57) ABSTRACT

Provided is a head covering comprising a generally triangular shaped fabric sheet having an inner surface and an outer surface, the fabric sheet having a front edge and first and second opposing edges, at least one evaporative cooling fabric secured to the inner surface of the fabric sheet, and a first and second stretchable fabric panel located on or within the fabric sheet. A method of aiding thermoregulation of the human body and a kit including a head covering and instructions for use is also provided.

18 Claims, 6 Drawing Sheets

(56) References Cited

U.S. PATENT DOCUMENTS

| | | | | | |
|---|---|---|---|---|---|
| 5,685,016 | A | * | 11/1997 | Douglas | 2/171 |
| 5,692,380 | A | * | 12/1997 | Cox et al. | 62/56 |
| 5,715,540 | A | * | 2/1998 | Cho | 2/195.3 |
| 5,740,556 | A | * | 4/1998 | Brown | 2/181 |
| D394,538 | S | * | 5/1998 | Murray | D2/891 |
| 5,781,932 | A | * | 7/1998 | Brown | 2/181 |
| 5,800,491 | A | * | 9/1998 | Kolen et al. | 607/108 |
| 5,860,165 | A | * | 1/1999 | Cvijanovich | 2/195.1 |
| 5,906,006 | A | * | 5/1999 | Castro, Jr. | 2/207 |
| 6,131,202 | A | * | 10/2000 | Yan | 2/195.3 |
| 6,205,590 | B1 | * | 3/2001 | Gorman | 2/181 |
| 6,349,414 | B1 | * | 2/2002 | Tillman | 2/170 |
| 6,353,936 | B2 | * | 3/2002 | Flatt | 2/181 |
| 6,564,390 | B2 | * | 5/2003 | Vernon | 2/171 |
| 6,665,876 | B1 | * | 12/2003 | Newman | 2/59 |
| 6,675,395 | B1 | * | 1/2004 | Abraham | 2/425 |
| 6,789,272 | B2 | * | 9/2004 | Thorson | 2/426 |
| 6,971,122 | B2 | * | 12/2005 | Sanchez | 2/181.6 |
| D519,716 | S | * | 5/2006 | Smith | D2/875 |
| D524,014 | S | * | 7/2006 | Park | D2/894 |
| 7,093,303 | B2 | * | 8/2006 | Thorson | 2/13 |
| 7,131,148 | B1 | * | 11/2006 | Traumer | 2/426 |
| 7,398,559 | B2 | * | 7/2008 | Flatt | 2/181 |
| 7,591,025 | B2 | * | 9/2009 | McGhee | 2/206 |
| 7,678,094 | B1 | * | 3/2010 | Cannon et al. | 604/385.15 |
| 7,774,861 | B1 | * | 8/2010 | Schmidt | 2/181 |
| D627,955 | S | * | 11/2010 | Schrab | D2/881 |
| D636,153 | S | * | 4/2011 | Schrab | D2/881 |
| 7,966,671 | B2 | * | 6/2011 | Cho | 2/181 |
| 8,185,969 | B2 | * | 5/2012 | Chang | 2/9 |
| D712,094 | S | * | 8/2014 | Branson | D28/41 |
| 2002/0073481 | A1 | * | 6/2002 | Creagan et al. | 2/458 |
| 2002/0083509 | A1 | * | 7/2002 | Douglas | 2/172 |
| 2002/0112499 | A1 | * | 8/2002 | Goldfine | 62/316 |
| 2004/0054341 | A1 | * | 3/2004 | Kellenberger et al. | 604/368 |
| 2004/0054342 | A1 | * | 3/2004 | Newbill et al. | 604/368 |
| 2004/0163162 | A1 | * | 8/2004 | Benziger | 2/411 |
| 2005/0097655 | A1 | * | 5/2005 | Bascom | 2/171 |
| 2006/0144557 | A1 | * | 7/2006 | Koscheyev et al. | 165/45 |
| 2006/0278252 | A1 | * | 12/2006 | Miller | 132/274 |
| 2007/0074326 | A1 | * | 4/2007 | Komechak | 2/12 |
| 2007/0118971 | A1 | * | 5/2007 | Blecha | 2/207 |
| 2008/0022438 | A1 | * | 1/2008 | Schweers et al. | 2/181 |
| 2009/0077716 | A1 | * | 3/2009 | Farney | 2/181 |
| 2011/0034887 | A1 | * | 2/2011 | Forden et al. | 604/291 |
| 2011/0207382 | A1 | * | 8/2011 | Kent | 450/11 |
| 2011/0209710 | A1 | * | 9/2011 | Spencer, III | 128/206.12 |
| 2011/0265247 | A1 | * | 11/2011 | Nolan | 2/181 |
| 2012/0066157 | A1 | * | 3/2012 | Brown, Jr. | 705/500 |

* cited by examiner

HEAD COVERING

BACKGROUND OF THE INVENTION

The human body is able to maintain a comfortable temperature range through the process of thermoregulation. When the human body is exposed to an environment that exhibits a temperature higher than the body's temperature, the thermoregulation process generates sweat resulting in subsequent evaporation and cooling. The human body is not always able to sustain a sufficient comfort level by this sweat generation/sweat evaporation mechanism and, thus, humans often resort to the use of head coverings to aid in the thermoregulation process. Typical head coverings include those formed from woven fabrics such as cotton that are formed into articles, such as bandanas or headbands. These head coverings are designed for placement against the skin to absorb sweat, with the sweat thereafter evaporating from the fabric to create a cooling effect. Woven fabrics, such as those made from cotton, are impervious to radiant heat from the sun and may often be wetted with water to aid in hastening the evaporative, cooling process. The overall cooling capacity of woven fabrics (e.g., cotton) in intense, humid climates, however, may become diminished.

Another challenge associated with head coverings worn in extreme outside temperatures is comfort over prolonged periods of continuous use. Soldiers or outdoor laborers working outside for many hours a day, for example, may prefer to wear a head covering either alone or in combination with a safety helmet, shield, or mask that attaches to the head to aid in warmth, cooling, or overall comfort or protection from wind or sun. Existing head coverings exposed to such extreme elements tend to become stretched, stiff, and generally ill-fitting over the course of a work day.

Thus, there remains a need for a comfortable head covering capable of prolonged use that aids the human body in the thermoregulation process while not becoming susceptible to the aforementioned challenges.

SUMMARY OF THE INVENTION

Provided is a head covering that includes a generally triangular shaped fabric sheet having an inner surface and an outer surface, the fabric sheet having a front edge and first and second opposing edges, at least one evaporative cooling fabric secured to the inner surface of the fabric sheet, a first stretchable fabric panel located on or within the fabric sheet, and a second stretchable fabric panel located on or within the fabric sheet. According to one embodiment, the head covering is a bandana. According to another embodiment, the head covering is a headband. According to one embodiment, the fabric sheet comprises woven or nonwoven cotton, polyester, or nylon. According to one embodiment, the at least one evaporative cooling fabric is formed from polyvinyl alcohol (PVA) fibers. According to another embodiment, the at least one evaporative cooling fabric comprises a polyvinyl alcohol (PVA)-based gel, a PVA/polyvinylpyrrolidone (PVP) blend-based gel, or a PVP-based gel. The at least one evaporative cooling fabric is further capable of exhibiting a temperature that is from about 5° F. to about 35° F. cooler than the surrounding, ambient air temperature. According to one embodiment, the at least one evaporative cooling fabric covers from about 5% to about 55% of the inner surface of the fabric sheet. According to one embodiment, the head covering includes one or more evaporative cooling fabrics including one that extends from the front edge of the fabric sheet towards the first and second opposing edges of the fabric sheet and one secured to a middle portion of the inner surface of the fabric sheet. According to one embodiment, the first and second stretchable panels extend vertically from directly above or behind a user's ear when the head covering is placed on a user's head. The first and second stretchable panels can comprise a polyurethane-polyurea copolymer (e.g., spandex or elastane).

According to another aspect, a method of aiding thermoregulation of the human body is provided. The method includes the steps of providing the head covering as provided herein, introducing the at least one evaporative cooling fabric to water, adjusting the head covering such that the at least one evaporative cooling fabric is in contact with a user's forehead, temples, head or any combination thereof, and tying the head covering around the perimeter of or onto a user's head, wherein the evaporative cooling fabric provides a cooling effect on the skin thereby aiding the body in thermoregulation.

According to another aspect, a kit is provided. The kit includes a head covering as provided herein and instructions for use.

DETAILED DESCRIPTION OF THE INVENTION

Figure 1:
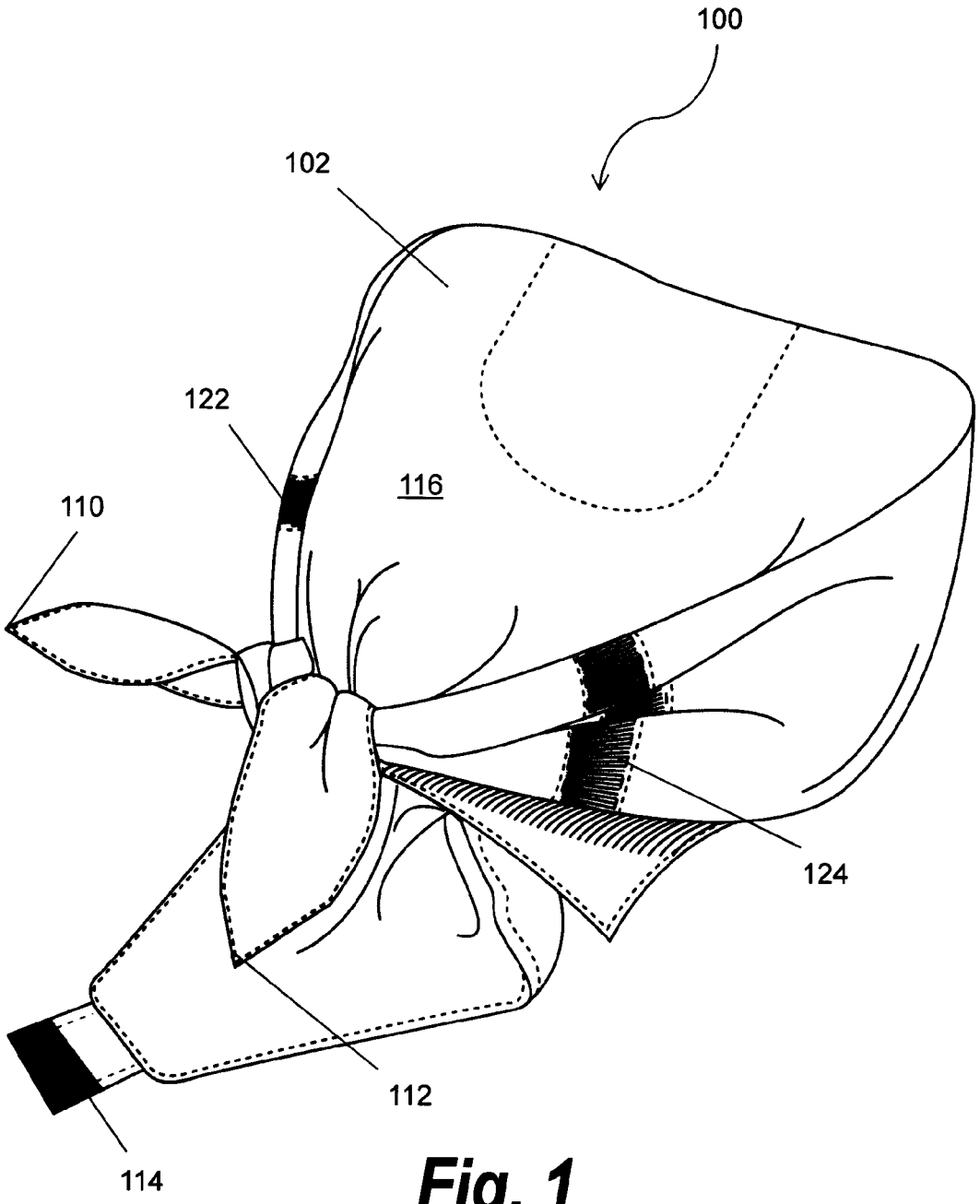
FIG. 1 is a rear perspective view of a head covering according to an embodiment of the invention.

As used herein, the term "head covering" refers to any article used to cover any or all portions of a human head. Suitable examples include, but are not limited to, bandanas and headbands as described herein.

Provided is a head covering comprising a generally triangular shaped fabric sheet having an inner surface and an outer surface, the fabric sheet having a front edge and first and second opposing edges, at least one evaporative cooling fabric secured to the inner surface of the fabric sheet, and a first and second stretchable fabric panel located on or within the fabric sheet. A method of aiding thermoregulation of the human body and a kit including a head covering and instructions for use is also provided.

The fabric sheet as described herein can be a woven or nonwoven cotton, wool, polyester, or nylon mesh, cloth, felt or any other suitable breathable blend or composite material selected for comfort and stability when applied around or on a user's head. Alternatively, the fabric sheet may be manufactured wholly from or partially from heat resistant fibers such as Nomex, Kevlar, PBI, FR, Rayon, Kremel, and PAN-based fibers. The fabric sheet may be a single piece of fabric, or may be a pair of fabric pieces, joined each to the other, to form a unitary fabric sheet. The size and coverage of the fabric sheet may vary according to the size and configuration of the end article (e.g., bandana or headband). The fabric sheet and any stitching within the fabric sheet may also be manufactured to be of any of a variety of one or more colors depending on the end use. For example, the fabric sheet may be manufactured with a high visibility fiber to aid in the identification of a construction worker, electrician, or plumber. The fabric sheet may further include reflective fibers or fibers treated with a reflective composition so as to aid in identification of an individual in low light.

The evaporative cooling fabric as described herein can include a single fabric, or combination of fabrics, that assists in the thermoregulation process of the human body. The evaporative cooling fabric can be highly absorbent to water and capable of exerting a cooling effect by virtue of the evaporation of the absorbed water thereby assisting in the human body's thermoregulation process. The evaporative cooling fabric may be a woven, nonwoven, or knit. The evaporative cooling fabric can be wind and ultraviolet resistant or fully wind and ultraviolet blocking. The evaporative cooling fabric can be resistant to stains caused by common encounters with dirt or oil from the environment or the user's skin. The evaporative cooling fabric can also be treated with an antimicrobial agent or solution to aid in the reduction of odor associated with interaction of sweat with bacteria in or on the hair or skin of the user.

According to one embodiment, the evaporative cooling fabric is manufactured from a material or fiber that is hydrophilic. By wicking away from the user's skin and retaining water, the fabric aids in the evaporative and cooling effect to the user. The evaporative cooling fabric is capable of being re-introduced to water repeatedly upon drying so as to sustain the cooling effect to the user of a prolonged period of time. The evaporative cooling fabric is further capable of exhibiting a temperature that is from about 5° F. to about 35° F. cooler than the surrounding, ambient temperature. The overall size of the evaporative cooling fabric may vary depending on the overall size of the head covering. According to one embodiment, the evaporative cooling fabric covers from about 5% to about 55% of the inner surface of the fabric sheet.

According to a preferred embodiment, the evaporative cooling fabric is formed from polyvinyl alcohol (PVA) fibers. According to an alternative embodiment, the evaporative cooling fabric can be impregnated with a polymer gel. The gel may be, for example, a polyvinyl alcohol (PVA)-based gel, a PVA/polyvinylpyrrolidone (PVP) blend-based gel, or a PVP-based gel. In such embodiments, the evaporative cooling fabric may be fabricated in the form of a sleeve or pouch adapted to receive the polymer gel. The polymer gel may be frozen or previously frozen prior to introduction to the evaporative cooling fabric or pouch formed therefrom.

Cooling agents may also be applied to any embodiment of the evaporative cooling fabric to enhance the physiological cooling sensation to a user. Exemplary cooling agents include menthol, icilin, isopulegol, 3-(1-menthoxy)propane-1,2-diol, 3-(1-menthoxy)-2-methylpropane-1,2-diol, p-menthane-2,3-diol, p-menthane-3,8-diol, 6-isopropyl-9-methyl-1,4-dioxaspiro[4,5]decane-2-methanol, menthyl succinate and its alkaline earth metal salts, trimethylcyclohexanol, N-ethyl-2-isopropyl-5-methylcyclohexanecarboxamide, Japanese mint oil, peppermint oil, menthone, menthone glycerol ketal, menthyl lactate, 3-(1-menthoxy)ethan-1-ol, 3-(1-menthoxy)propan-1-ol, 3-(1-menthoxy)butan-1-ol, 1-menthylacetic acid N-ethylamide, 1-menthyl-4-hydroxypentanoate, 1-menthyl-3-hydroxybutyrate, N,2,3-trimethyl-2-(1-methylethyl)-butanamide, n-ethyl-t-2-c-6 nonadienamide, N,N-dimethyl menthyl succinamide, and menthyl pyrrolidone carboxylate.

The stretchable fabric and associated panels as described herein are capable of expanding and contracting (i.e., exhibiting elasticity) to aid in a user's comfort over long periods of use and for ease of application and removal of the head covering. The stretchable fabric panels are also capable of receiving and holding various small objects against the user's head for quick access. Exemplary small objects include pens, pencils, and lighters. Alternatively, the head covering may include a single large loop or a hook and loop system (e.g., Velcro) on an outer surface for securing such small objects.

According to one embodiment, the stretchable fabric is manufactured from any elastic fiber that imparts some degree of elasticity to the head covering. According to one embodiment, the stretchable fabric is a polyurethane-polyurea copolymer such as spandex. According to another embodiment, the stretchable fabric is a blend of spandex and other natural or synthetic fibers that are woven, knit or spun to provide a stretch-recoverable laminate or composite fabric. Suitable natural or synthetic fibers include polyester, nylon and cotton. The stretchable fabric can be joined to the surrounding portions of any fabric sheet by use of adhesives, ultrasonic bonding, needling, stitching, or any other method that does not interfere with or otherwise reduce the elasticity of the stretchable fabric.

In use, the head covering embodiments as described herein can be dipped, immersed, or otherwise introduced to water or other cooling solvent at the user's discretion. After introduction, the evaporative cooling fabric portions of the head covering are preferably positioned on or near locations on or around the user's head that are known to play a role in the human body's thermoregulation process such as the forehead, temples or top of the head. Once properly positioned, the tie ends may be pulled and tied (e.g., in a knot) to secure the head covering on or around the user's head. The head covering will aid in the thermoregulation of the human body by the evaporative cooling process discussed herein for varying amounts of time depending on the surrounding, ambient conditions. The head covering is particularly useful for any individual that performs activities (e.g., work or leisure) in conditions where the human body is subject to heat that induces a thermoregulatory response. Such individuals include soldiers, construction workers, foundry workers, firemen, police, welders, plumbers, roofers, or electricians. Other individuals may choose to utilize the head coverings as described herein for leisure or sport activities such as motorcycling, golf, football, baseball, running or track/field-related sports.

As illustrated in FIGS. 1-4, the head covering may be formed in the shape of a bandana 100 and generally worn to provide protection, cooling or warmth. The bandana 100 can be worn alone or in combination with protective equipment such as helmets or masks. The bandana 100 is generally formed from a fabric sheet 102 having a substantially triangular shape and contour having a front edge 104 and opposing side edges (106, 108). At each opposing end of the triangular shape, the fabric sheet 102 includes three tie ends (110, 112, 114). As illustrated, at least one tie end 114 may include any gripping overlay material capable of aiding in gripping, wrapping and tying of the bandana around the user's head. Suitable gripping overlay materials include any natural or synthetic polymer, elastomer, or other rubber or plastic-like material capable of adhering to the tie ends and providing grip to the user. The fabric sheet 102 further includes an outer surface 116 and inner surface 118.

Figure 4:
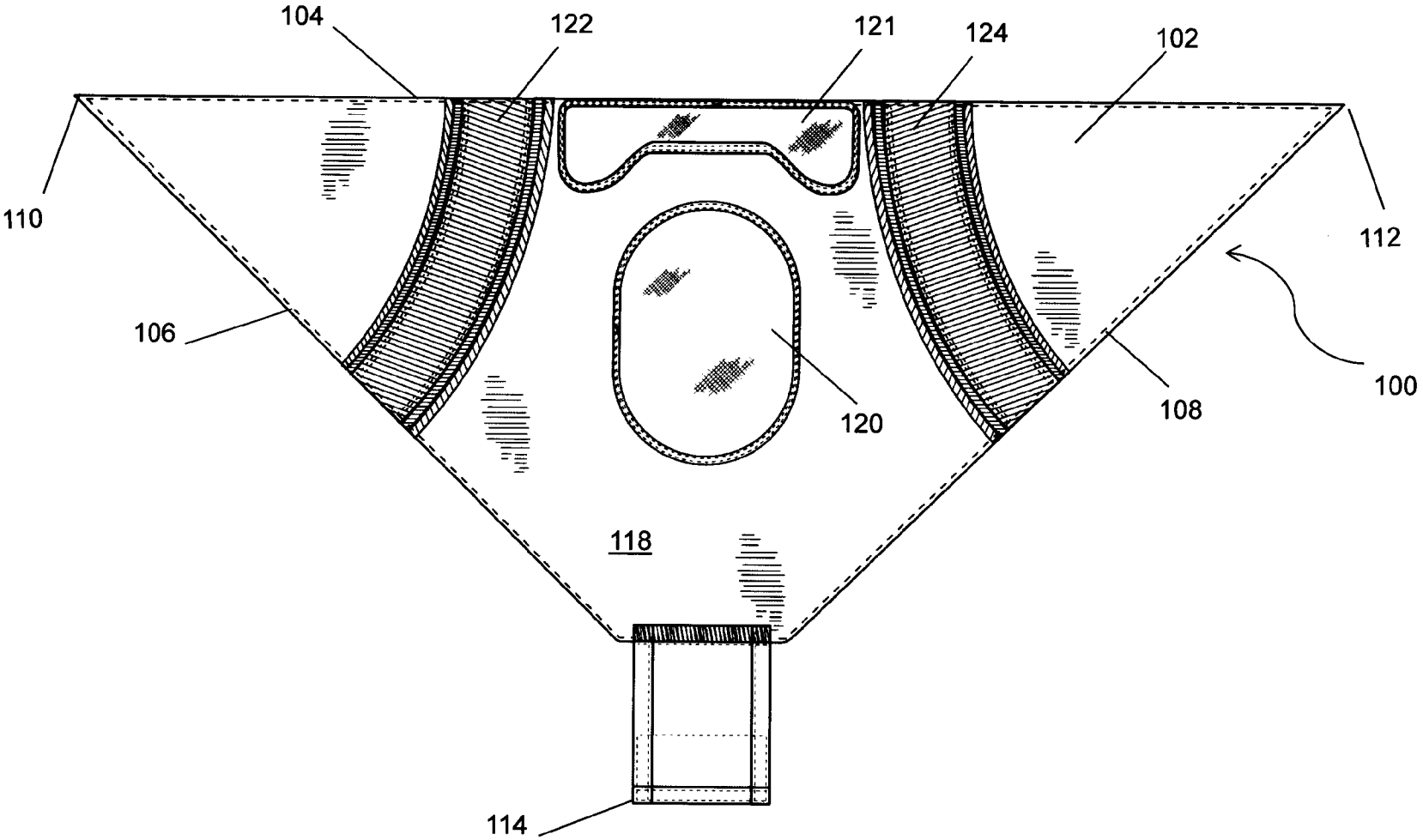
FIG. 4 is a bottom plan view of the head covering according to the embodiment of FIG. 1.

As illustrated in FIG. 4, a first evaporative cooling fabric 120 is stitched to the inner surface 118 of the fabric sheet 102 on an upper portion of the head. A second evaporative cooling fabric 121 is stitched behind the front edge 104 and extends between a first and second stretchable fabric panel (122, 124). Either evaporative cooling fabric (120, 121) may be used alone or in combination with one another. The location of the evaporative cooling fabric (120, 121) may vary such that contact is established with a user's hair, skin, pressure points, or a combination thereof to aid in thermoregulation. As illustrated, the evaporative cooling fabric 120 is stitched to the fabric sheet 102. Alternatively, the evaporative cooling fabric 120 may be fastened to the fabric sheet 102 in any manner that allows for efficient, easy application and removal, for example, a hook and loop system (e.g., Velcro). In yet another embodiment, the evaporative cooling fabric 120 may be glued to the fabric sheet 102.

As illustrated in FIGS. 1-4, the first evaporative cooling fabric 120 is generally shaped as a multi-sided polygon that extends from the front edge 104 of the inner surface 118 so as to be in contact with a user's forehead with raised portions that separately extend across the top, front portion of a user's head. The second evaporative cooling fabric 121 is generally oblong or egg shaped and extends along a top surface of a user's heard. The shapes of the evaporative cooling fabrics (120, 121) may vary such that an evaporative, cooling effect is felt on the user's forehead, temples, top of head, or any other area on the user's head that aids in thermoregulation.

Figure 2:
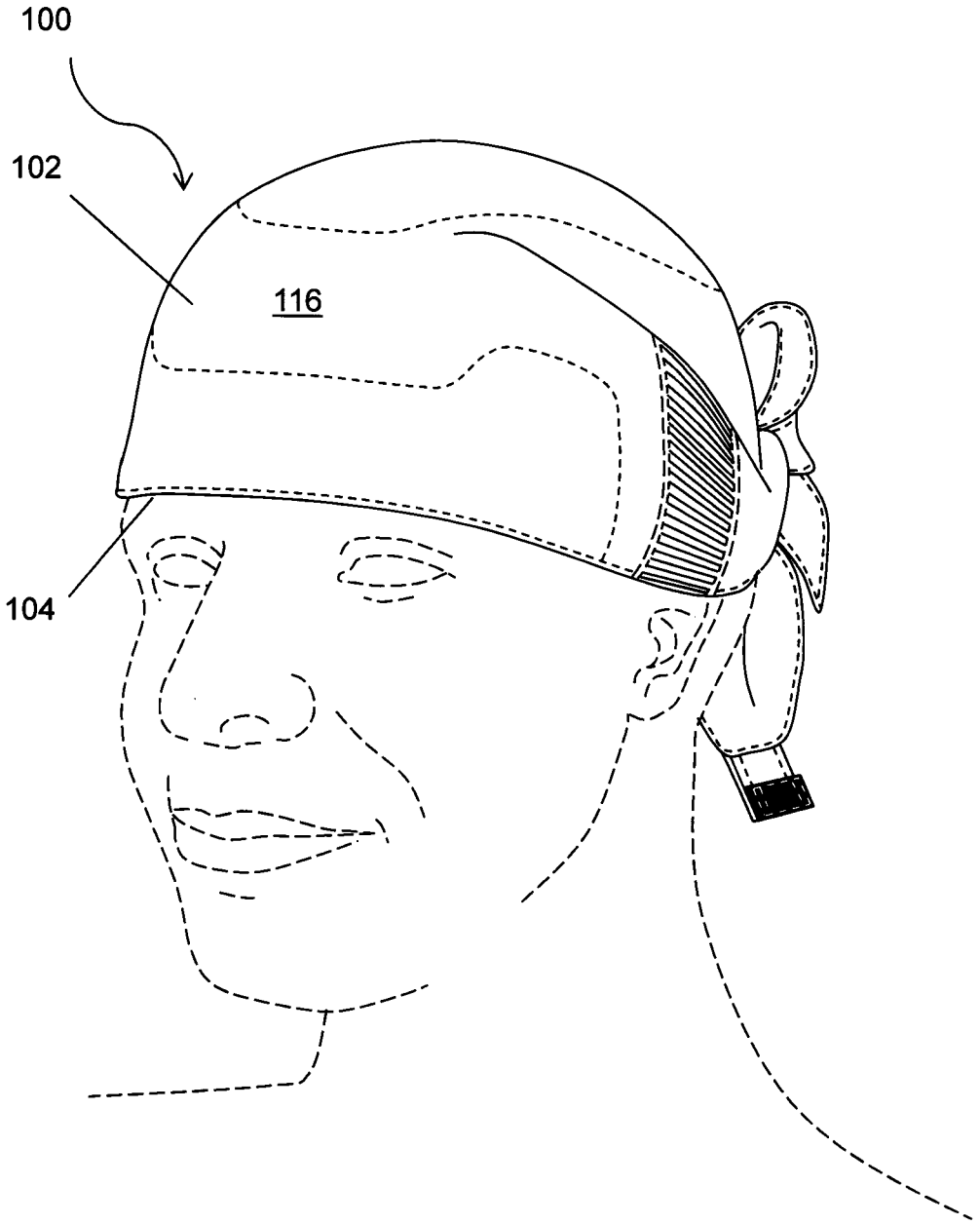
FIG. 2 is a front perspective view of the heading covering according to the embodiment of FIG. 1.
Figure 3:
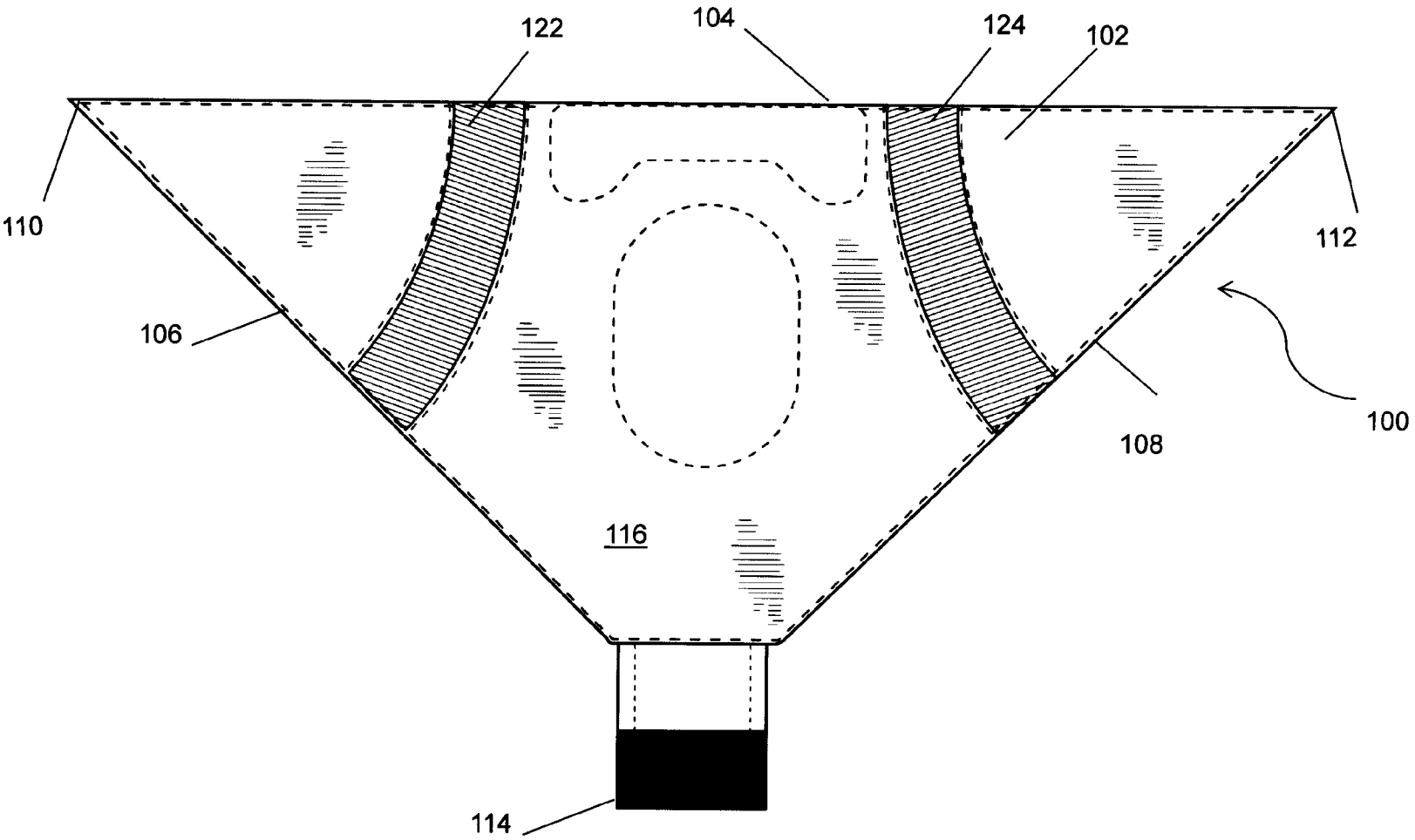
FIG. 3 is a top plan view of the head covering according to the embodiment of FIG. 1.

The head covering of FIGS. 1-4 further includes a first and second stretchable fabric panel (122, 124). As illustrated in the embodiment of FIGS. 3-4, each stretchable fabric panel (122, 124) extends from the front edge 104 to an opposing side edge (106, 108). As illustrated in FIG. 2, the stretchable fabric panels (122 or 124) extend vertically above or directly behind the user's ear. The width of the stretchable fabric panels (122 or 124) may vary according to the overall dimensions of the bandana. According to one embodiment, the stretchable fabric panels (122 or 124) are from about 0.25" to about 3" wide.

Figure 5:
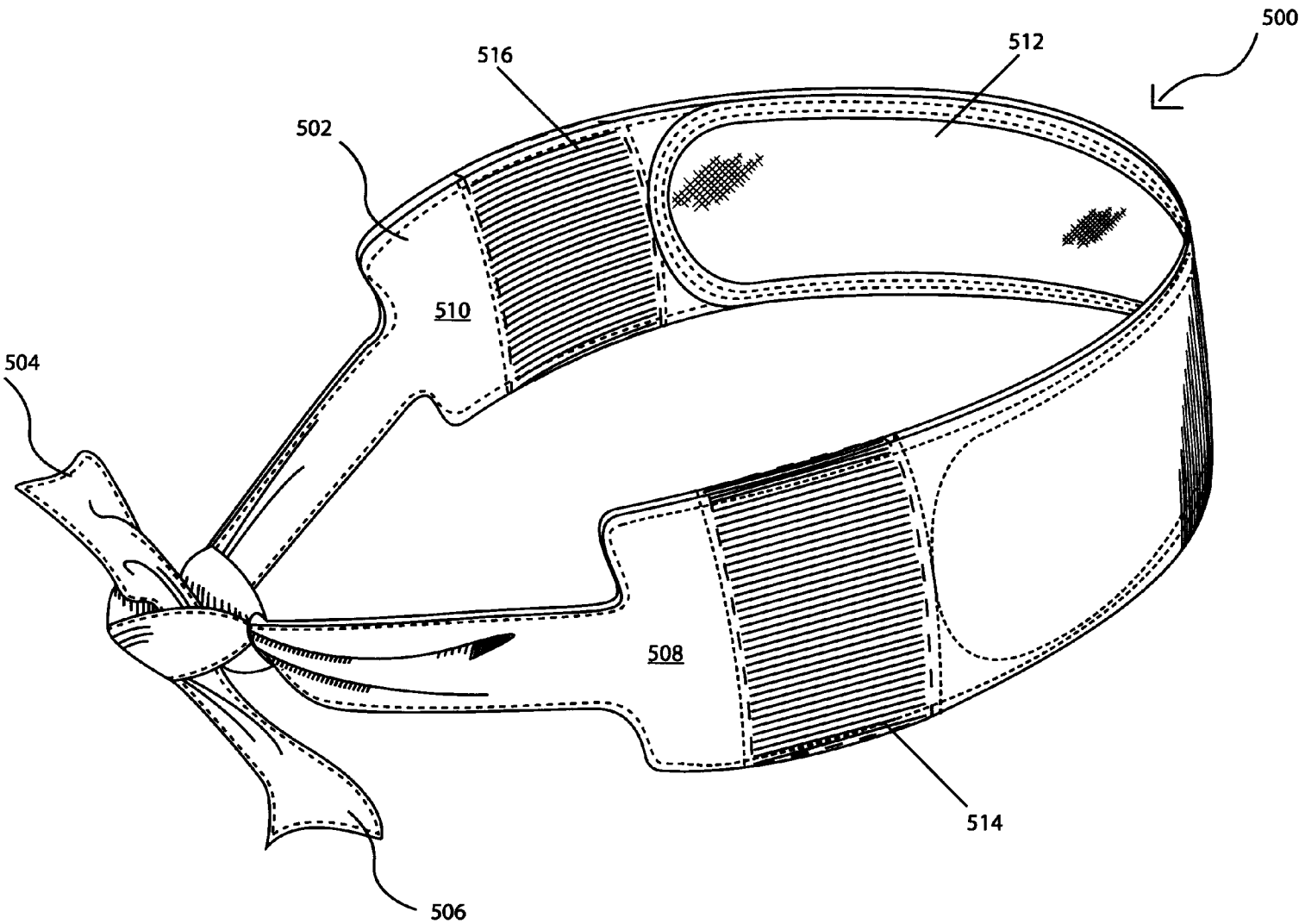
FIG. 5 is perspective view of a head covering according to an alternative embodiment.
Figure 6:
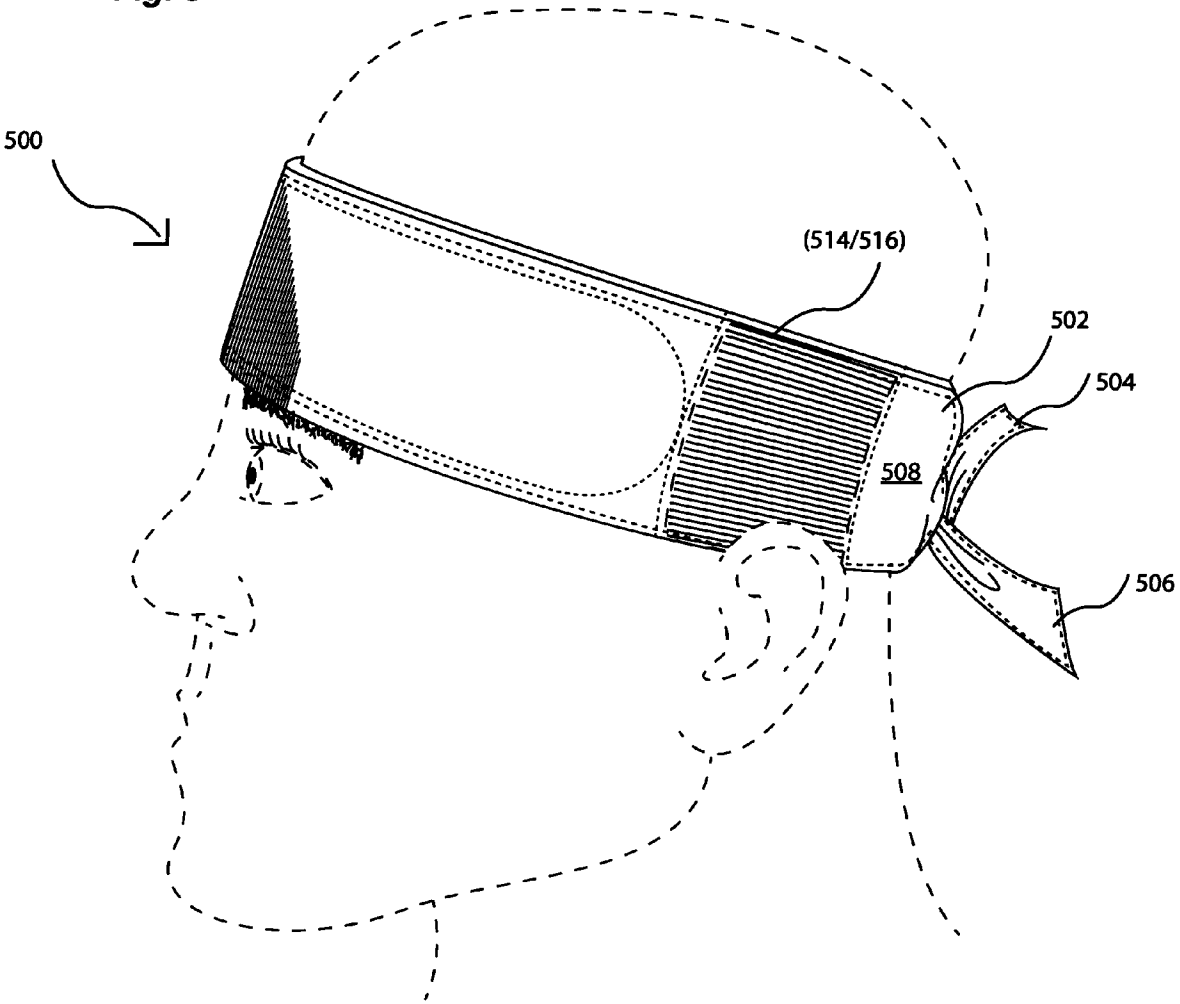
FIG. 6 is a side perspective view of the head covering embodiment of FIG. 5.

As illustrated in FIGS. 5-6, the head covering may be formed in the shape of a headband 500. The headband 500 is generally formed from a fabric sheet 502 that includes opposing tie ends (504, 506). The fabric sheet 502 includes an outer surface 508 and an inner surface 510. The inner surface 510 includes an evaporative cooling fabric 512 for contacting the user's forehead and temples. As described in more detail herein, the evaporative cooling fabric 512 may absorb perspiration from the user's forehead and temples, preventing perspiration from dripping in the user's eyes and providing a cooling effect for the user through evaporative cooling.

As illustrated, the evaporative cooling fabric 512 is stitched to the inner surface 510 of the fabric sheet 502. Alternatively, the evaporative cooling fabric 512 may be fastened to the fabric sheet 502 in any manner that allows for efficient, easy application and removal, for example, a hook and loop system (e.g., Velcro). In yet another embodiment, the evaporative cooling fabric 512 may be glued to the fabric sheet 502.

The headband 500 further includes a first and second stretchable fabric panel (514, 516) located between the evaporative cooling fabric 512 and tie ends (504, 505). As illustrated, the stretchable fabric panels (514, 516) are generally located in the area directly above or behind the user's ear. The width of the stretchable fabric panels (514, 516) may vary according to the overall dimensions of the headband. According to one embodiment, the stretchable fabric panels (514, 516) are from about 0.25" to about 3" wide.

While some embodiments have been shown and described, various modifications and substitutions may be made thereto without departing from the spirit and scope of the invention. For example, for claim construction purposes, it is not intended that the claims set forth hereinafter be construed in any way narrower than the literal language thereof, and it is thus not intended that exemplary embodiments from the specification be read into the claims. Accordingly, it is to be understood that the present invention has been described by way of illustration and not limitations on the scope of the claims.

I claim:

1. A covering adapted for the head comprising:

a fabric sheet having an inner surface and an outer surface, the fabric sheet having a front edge, first and second opposing side edges, a first tie end defined by the front edge and the first side edge, and a second tie end defined by the front edge and the second side edge, wherein when the fabric sheet is laid flat, the fabric sheet is generally triangular in shape, the front edge is coincident with a side of a first angle, the first side edge is coincident with the other side of the first angle, the front edge is coincident with a side of a second angle, and the second side edge is coincident with the other side of the second angle;

at least one evaporative cooling fabric secured to the inner surface of the fabric sheet;

a first elastic fabric panel located on or within the fabric sheet and having, when the fabric sheet is laid flat, a first arcuate shape extending across the sheet from the front edge to the first side edge; and a second elastic fabric panel located on or within the fabric sheet and having, when the fabric sheet is laid flat, a second arcuate shape extending across the sheet from the front edge to the second side edge;

wherein the first and second elastic panels are configured so that if the covering were placed on a user's head, with the front edge placed across a forehead of the user's head and the first and second tie ends tied together behind the user's head, each elastic panel would extend vertically directly above or behind a user's respective ear for a distance greater than each fabric panel extends horizontally; and wherein the first and second stretchable panels are a different material than the fabric sheet.

2. The covering of claim 1, wherein the covering is a bandana.

3. The covering of claim 1, wherein the covering is a headband.

4. The covering of claim 1, wherein the fabric sheet comprises a woven or nonwoven cotton, polyester, or nylon.

5. The covering of claim 1, wherein the at least one evaporative cooling fabric is formed from polyvinyl alcohol (PVA) fibers.

6. The covering of claim 1, wherein the at least one evaporative cooling fabric is capable of exhibiting a temperature that is from 5° to 35° cooler than the surrounding, ambient air temperature.

7. The covering of claim 1, wherein the at least one evaporative cooling fabric comprise a polyvinyl alcohol (PVA)-based gel, a PVA/polyvinylpyrrolidone (PVP) blend-based gel, or a PVP-based gel.

8. The covering of claim 1, wherein the at least one evaporative cooling fabric covers from 5% to 55% of the inner surface of the fabric sheet.

9. The covering of claim 1, wherein the first and second elastic panels comprise a polyurethane-polyurea copolymer.

10. The covering of claim 1, including one evaporative cooling fabric extending from the front edge of the fabric sheet towards the first and second side edges of the fabric sheet.

11. The covering of claim 1, including one evaporative cooling fabric secured to a middle portion of the inner surface of the fabric sheet.

12. The covering of claim 1, including one evaporative cooling fabric extending from the front edge of the fabric sheet towards the first and second side edges of the fabric sheet and one evaporative cooling fabric secured to a middle portion of the inner surface of the fabric sheet.

13. A method of aiding thermoregulation of the human body comprising:

providing the covering of claim 1;

introducing the at least one evaporative cooling fabric to water;

adjusting the covering such that the at least one evaporative cooling fabric is in contact with a user's forehead, temples, head or any combination thereof; and tying the covering around the perimeter of or onto a user's head, wherein the evaporative cooling fabric provides a cooling effect on the skin thereby aiding the body in thermoregulation.

14. A kit comprising:

a covering adapted for the head; and instructions for use, wherein the covering comprises:

a fabric sheet having an inner surface and an outer surface, the fabric sheet having a front edge, first and second opposing side edges, a first tie end defined by the front edge and the first side edge, and a second tie end defined by the front edge and the second side edge, wherein when the fabric sheet is laid flat, the fabric sheet is generally triangular in shape, the front edge is coincident with a side of a first angle, the first side edge is coincident with the other side of the first angle, the front edge is coincident with a side of a second angle, and the second side edge is coincident with the other side of the second angle;

at least one cooling fabric secured to the inner surface of the fabric sheet;

a first elastic fabric panel located on or within the fabric sheet and having, when the fabric sheet is laid flat, a first arcuate shape extending across the sheet from the front edge to the first side edge; and a second elastic fabric panel located on or within the fabric sheet and having, when the fabric sheet is laid flat, a second arcuate shape extending across the sheet from the front edge to the second side edge;

wherein the first and second elastic panels are configured so that if the covering were placed on a user's head, with the front edge placed across a forehead of the user's head and the first and second tie ends tied together behind the user's head, each elastic panel would extend vertically directly above or behind a user's respective ear for a distance greater than each fabric panel extends horizontally;

and wherein the first and second stretchable panels are a different material than the fabric sheet.

15. The covering of claim 1, wherein when the fabric sheet is laid flat, the vertex of the first angle is located on the first tie end, and the vertex of the second angle is located on the second tie end.

16. The covering of claim 15, wherein when the fabric sheet is laid flat, the evaporative cooling fabric is positioned between the first elastic fabric panel and the second elastic fabric panel.

17. The covering of claim 11, wherein when the fabric sheet is laid flat, the one evaporative cooling fabric secured to a middle portion of the inner surface of the fabric sheet is positioned between the first elastic fabric panel and the second elastic fabric panel.

18. The covering of claim 12, wherein when the fabric sheet is laid flat, the one evaporative cooling fabric extending from the front edge of the fabric sheet towards the first and second side edges of the fabric sheet, and the one evaporative cooling fabric secured to a middle portion of the inner surface of the fabric sheet, are positioned between the first elastic fabric panel and the second elastic fabric panel.

* * * * *